US006138963A

United States Patent [19]

Malvasio

[11] Patent Number: 6,138,963

[45] Date of Patent: Oct. 31, 2000

[54] PAINT CUP AND BRUSH HOLDER

[76] Inventor: William A. Malvasio, 2550 N. Lake Dr., Unit B, Milwaukee, Wis. 53211

[21] Appl. No.: 09/378,916

[22] Filed: Aug. 23, 1999

[51] Int. Cl.[7] ..... A46B 17/02

[52] U.S. Cl. ..... 248/111; 248/145.6; 248/211; 220/696; 220/697; 220/736; 220/700; 220/555

[58] Field of Search ..... 248/111, 145.6, 248/110, 211; 220/696, 697, 736, 700, 555

[56] References Cited

U.S. PATENT DOCUMENTS

| | | | |
|---|---|---|---|
| Re. 35,933 | 10/1998 | Scholl | 220/696 X |
| 4,428,493 | 1/1984 | McDonough | 220/20 |
| 4,436,217 | 3/1984 | Ritter | 220/90 X |
| 4,756,046 | 7/1988 | Surface | 15/257.06 |
| 4,865,282 | 9/1989 | Yonkman et al. | 248/111 |
| 5,054,661 | 10/1991 | Hollje | 222/465.1 |
| 5,261,577 | 11/1993 | Goldstein et al. | 220/736 X |
| 5,322,183 | 6/1994 | Strachan | 220/736 X |
| 5,341,969 | 8/1994 | Accardo et al. | 222/465.1 |
| 5,810,196 | 9/1998 | Lundy | 220/736 |

*Primary Examiner*—Ramon O. Ramirez
*Assistant Examiner*—A. Joseph Wujciak
*Attorney, Agent, or Firm*—Arthur J. Hansmann

[57] ABSTRACT

A paint cup and brush holder configured in an uprightly disposed conical shape having a compartment for containing paint and an adjacent compartment for holding a brush. A doctor exists between the two compartments and at a level lower than the upper edge of the entire container for wiping the excess paint from the brush. There is a handle on the container and also a pour spout. The entire container is arranged in the conical shape so that it can be stacked in a plurality of containers.

9 Claims, 5 Drawing Sheets

PAINT CUP AND BRUSH HOLDER

This invention relates to an integral paint cup and brush holder. That is, in one conically shaped container, there is a paint compartment and a brush holder compartment.

BACKGROUND OF THE INVENTION

Paint containers, cans, and the like already exist in various configurations and shapes, and they are known to be arranged for holding paint and also for holding a paint brush. However, those devices are commonly arranged with separable attachments for mounting on the paint can itself, such as for holding the brush in a position within the paint can. As such, the brush is commonly subjected to all of the paint within the can, and, when the equipment is to be cleaned, then the brush holder must be cleaned by itself, in addition to cleaning the other equipment involved.

Improving upon the prior art, it is an object of this invention to provide an integral paint cup and brush holder arranged in one body and wherein that combined unit can be conveniently located at the paint site. Still further, the combined unit of this invention, as mentioned, will retain the paint in only a reasonable quantity, and it will also retain the paint brush when not in use. Still further, the unit is provided with a compartment for containing the paint and a separate compartment for retaining the paint brush, and there is a doctor integral between the two compartments whereby the brush can be wiped to remove paint from one side of the brush as in the usual painting procedure.

Still further, the combined unit of this invention is made of a manageable size which can be readily hand held at the site of the painting, and the brush can be securely retained within the unit when the painter is not using it.

Still further, the present invention provides for the aforementioned combined unit which is stackable, one within the other, so that only a minimum of space is required for the storing of a plurality of the containers, either in the merchant's store or in the user's storage area. Also, the container can be readily and inexpensively made, and is presentable in quantities, and it can thus be reasonably discarded after each use, and it need not be cleaned and salvaged for multiple uses.

In achieving the aforementioned, the combined unit of this invention includes a handle for supporting the unit and also a pour spout for emptying the paint remaining after the painter is finished.

DETAILED DESCRIPTION OF THE PREFERRED EMBODIMENT

Figure 1:
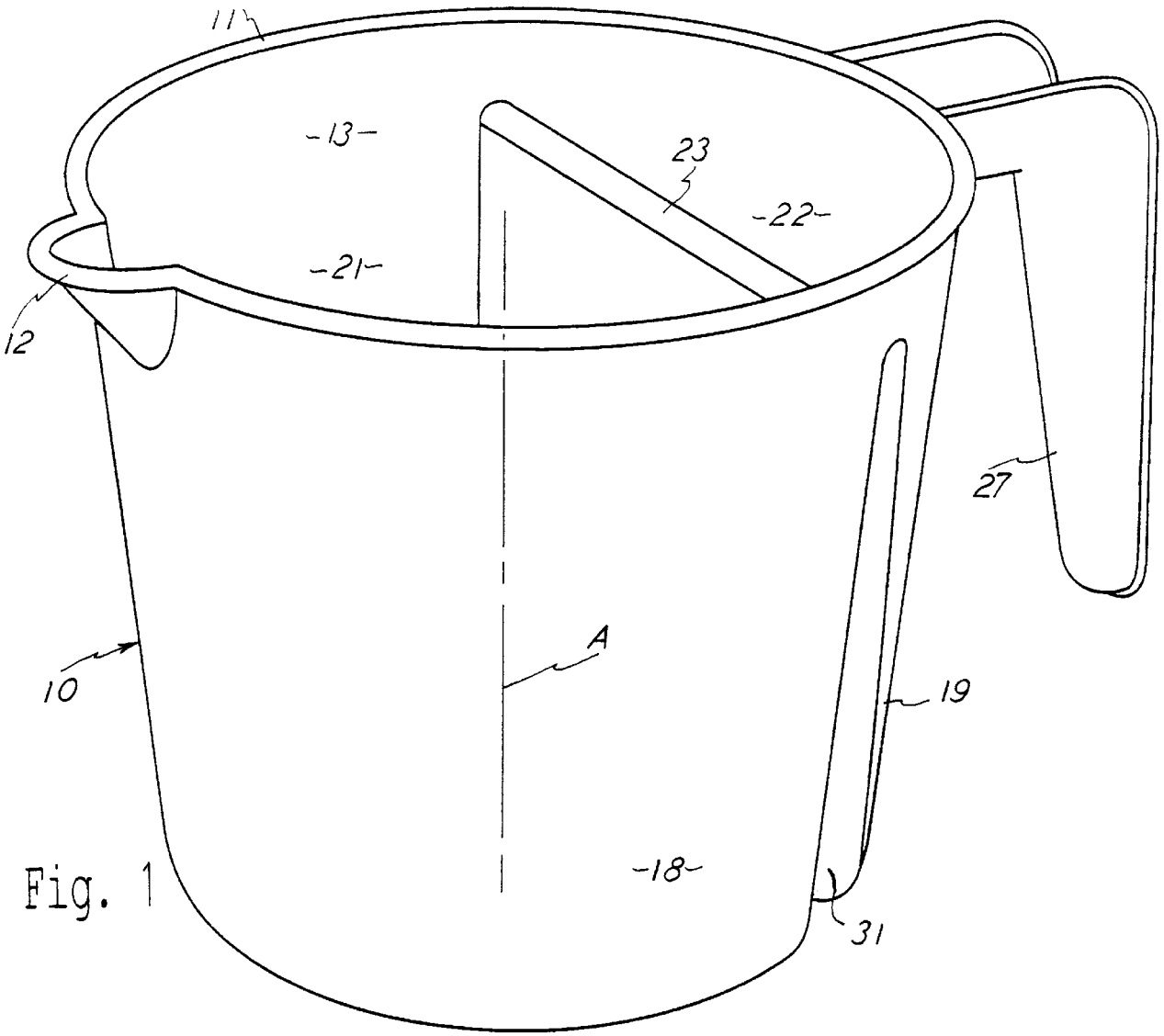
FIG. 1 is perspective view of an integral paint cup and brush holder of this invention.

The paint cup and brush holder of this invention as shown in FIG. 1 includes a body 10 which is conically shaped and extends about an upright axis designated A. An upper edge or rim 11 extends in a substantially circular pattern at the upper edge of the body 10, and it includes the deviated portion 12 which forms a paint pour spout which is useful when it is desired to retrieve the paint remaining in the body 10.

Figure 2:
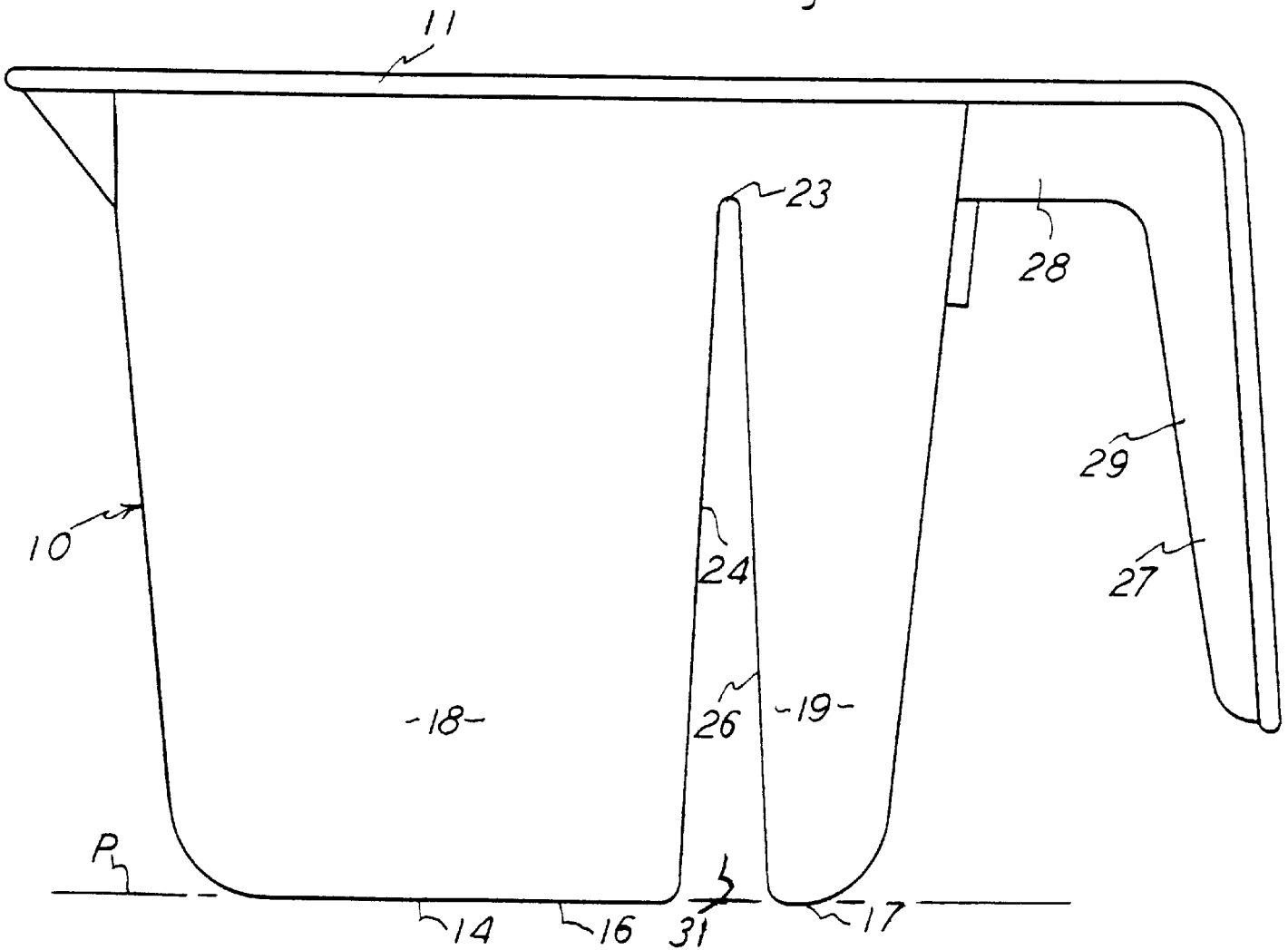
FIG. 2 is a side elevational view of the unit in FIG. 1.
Figure 3:
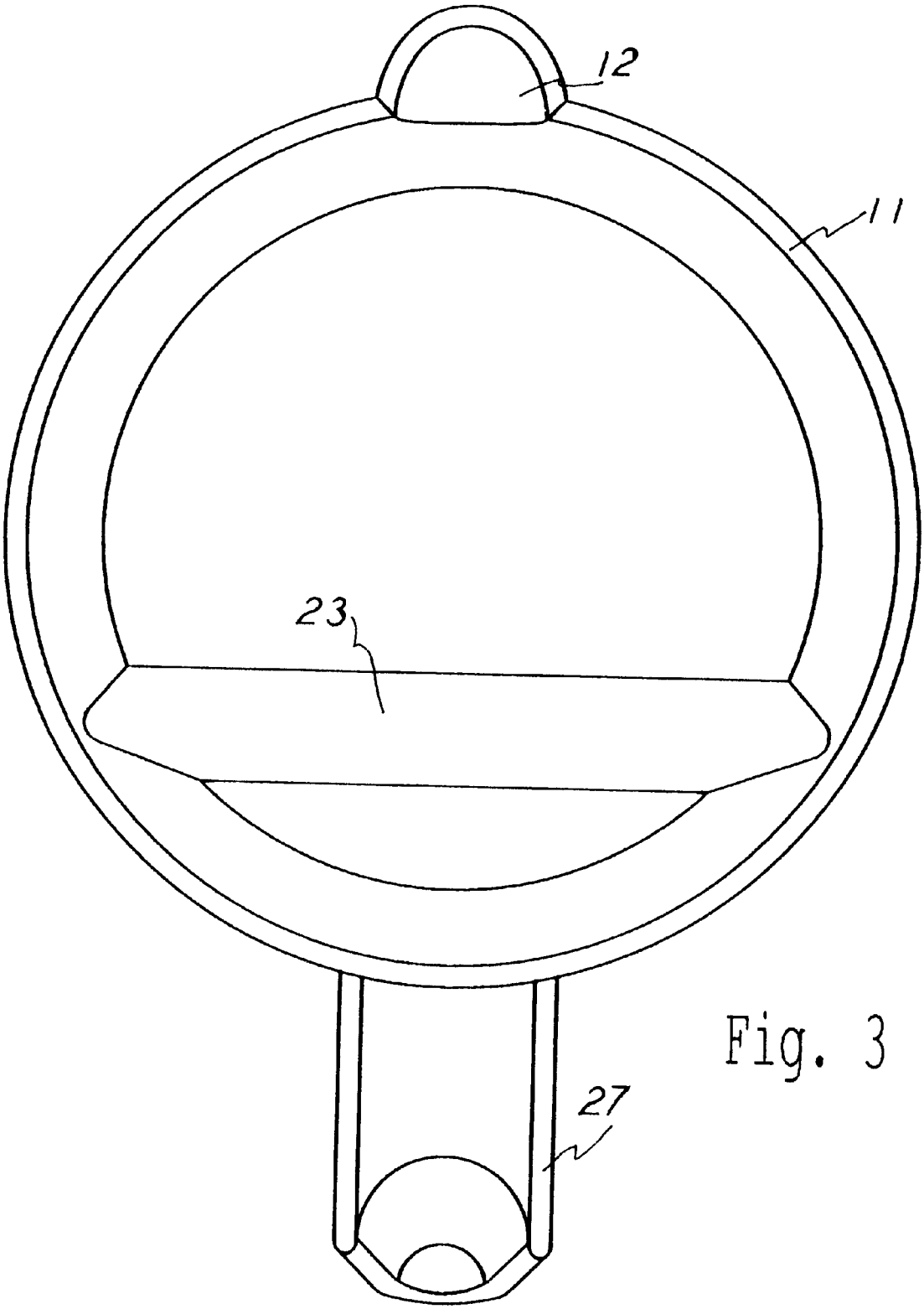
FIG. 3 is a top plan view of the unit in FIG. 1.
Figure 5:
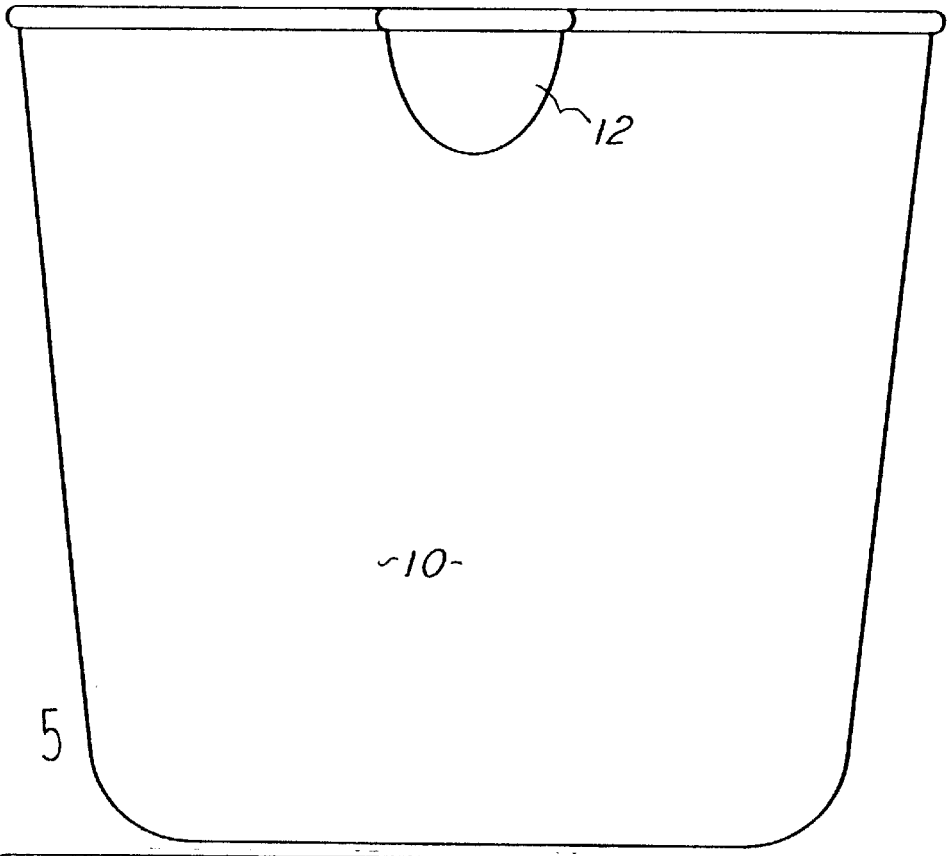
FIG. 5 is a front elevational view of the unit in FIG. 1.
Figure 4:
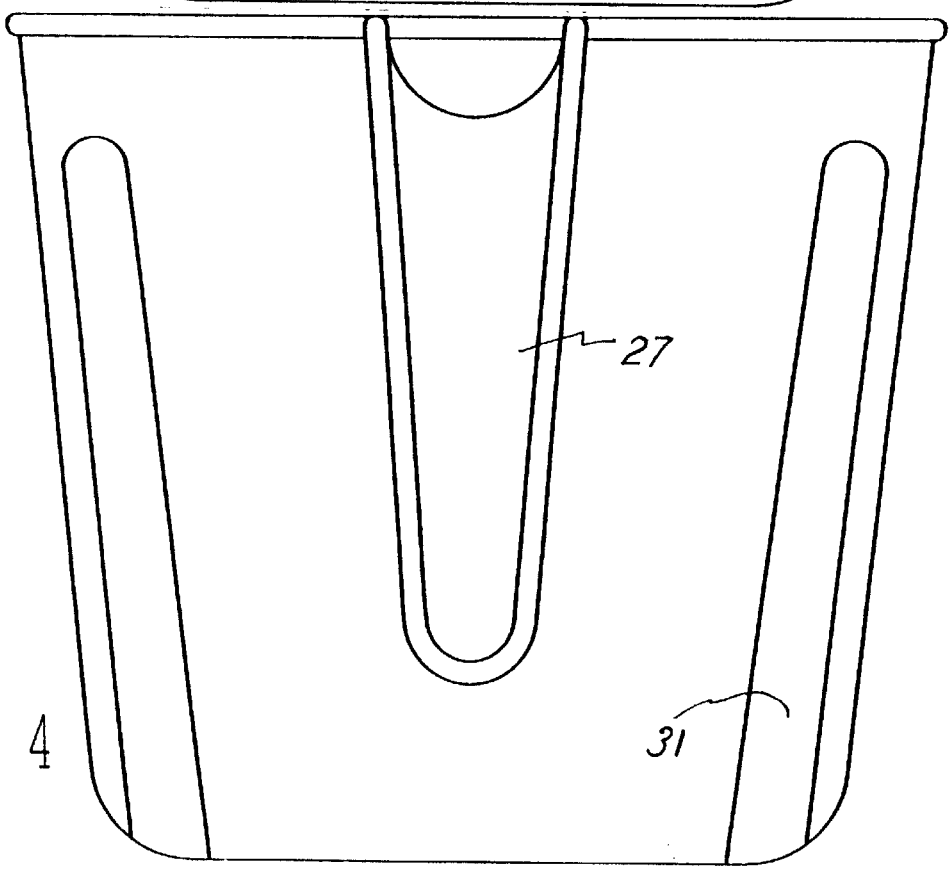
FIG. 4 is a front elevational view of the unit in FIG. 1.

Of course the circular upper edge or rim 11 provides an open top 13, and the rim 11 extends along a horizontal plane transverse to the axis A. Also, such as seen in FIG. 2, there is a second plane designated P which is parallel to the plane on which the upper edge 11 is disposed, and it is at the bottom of the container or body 10. Thus, the entire conical shape is concentric about the upright axis A and extends between the larger circle at the rim 11 and to the smaller circle at the bottom on the plane P. Thus, there is a bottom 14 which is seen in FIG. 2 to actually exist in a portion 16 and another portion 17, both of which extend along the plane P.

At an elevation lower than that of the upper edge 11, the body 10 has a first lower portion designated 18 and a second lower portion designated 19. The portions 18 and 19 respectively present a paint containing compartment 21 and a brush holding compartment 22, respectively. Now it will be seen and understood that the brush compartment 22 extends for the full upright length of the unit, and thus a brush disposed within the compartment 22 is secure and stable and not likely to have its extended handle overbalance itself to have the brush fall from the unit.

The drawings show that the portions 18 and 19 are spaced apart for almost their entire upright extents, and they terminate in a common horizontally disposed edge 23 where they are joined together. As shown, the portions 18 and 19 are defined by the endlessly extending walls shown respectively extending throughout each portion 18 and 19 and spaced apart from each other. The edge 23 is referred to as a doctor, and it is disposed at an elevation lower than that of the upper rim 11. As such, the painter can move the brush over that straight edge 23 and thus desirably remove excess paint from the brush, and that paint can be directed to flow back into the compartment 21 from whence it came. Thus, the doctor 23 extends as a chord across the conically shaped body 10, and it is available for the brush-wiping action described.

Figure 6:
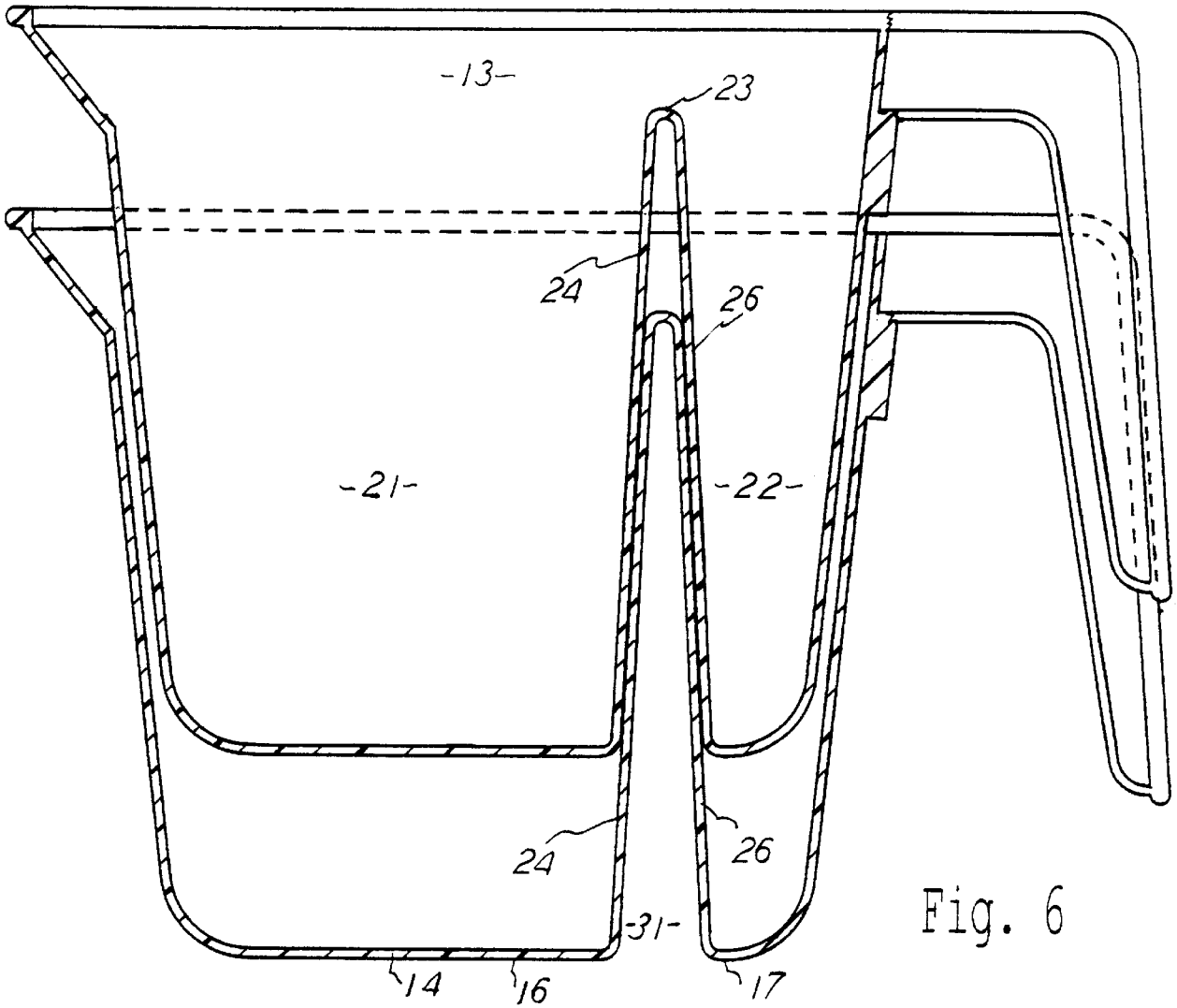
FIG. 6 is a side elevational view, in upright longitudinal section, showing two of the units in stacked relationship.

The body 10 therefore also includes two wall portions 24 and 26 which extend for virtually the length of the unit, as shown, and they diverge from each other in the direction downward relative to the upright axis A. As such, the walls 24 and 26 permit the nesting, as seen in FIG. 6. Also, with that arrangement, the angles shown in FIG. 6 on the entire unit as seen herein permits the draft angles for molding the unit and forming it of plastic or the like. Also, it will be seen that all the walls defining the unit are of the same and uniform thickness throughout as seen in FIG. 6.

The walls 24 and 26 are thus angled relative to each other but are spaced apart, and, as such, the brush-retaining portion 19 could itself serve as a handle when the painter's fingers are inserted in the space between the walls 24 and 26 to support the body 10 with its two lower portions 18 and 19 To further enhance the holding and maneuvering of the integral unit of this invention, a handle 27 is integral with the body 10 and extends spaced therefrom in a lateral extent in a portion 28 and in an angulated hand grip portion 29, as clearly seen in FIG. 2. With that arrangement, the operator can also have the option of gripping the handle 27 for maneuvering the unit while painting. The drawings also alternatively indicate that the painter can slide a hand up under the handle 27 at a location adjacent the handle portion 29 to a snug position between the body 10 and the handle portion 29 and then grip the body 10 with fingers, and that is a feature of a tapered fit which accommodates hands of differing sizes. Further, the handle 27 is diametrically opposite the location spout 12.

FIGS. 2 and 6 also clearly show that the handle portion 29 is angulated so that the unit can be conveniently leveled or positioned while painting, that is, the hand need not be held only in the upright position to have the unit level, and that angulated portion 29 also provides for the nesting relationship as seen in FIG. 6. Thus, the only restriction on the nesting of a plurality of the units is with regard to the two angulated walls 24 and 26, and therefore the units will not be unduly extended in the nested relationship and they will not tend to bind one to the other because the only relative surfaces between two units are those walls 24 and 26.

With the edge or doctor 23 extending as a complete chord relative to the circumference of the body 10 at the location of the chord 23, and with the walls 24 and 26 extending as shown, the body 10 will not distort under the weight of paint in the compartment 21. Of course all of the portions of the unit as shown and described herein are integral with each other and are made in one operation of molding, for instance, and thus there are the integral aspects provided for structural rigidity throughout the whole unit.

Also, FIG. 2 particularly shows that the bottoms 16 and 17 are vertically directly beneath the respective compartments 21 and 22 and thus the unit is stable when set on a level support, such as indicated by the plane P. That is, there will be no tendency for the unit to tip in any direction under the weight of either the brush or the paint because there is no cantilever effect with regard to either compartment 21 or 22 as related to the totality of the body 10.

In essence, there is a cup which is presented by the body 10 and is of the conical shape having a split or separation 31 therein, and that split is defined by the two opposing walls 24 and 26 which are joined together at their upper edge 23, as seen in FIG. 6. The body 10 is for containment and supplying a relatively small quantity of paint, say a pint or so, and the brush compartment 22 extends for the whole length of the conical body 10, for stability and being separated from the paint compartment 21. As such, the unit is arranged for the painter to use it in touchup and trim and like painting projects.

What is claimed is:

1. An integral paint cup and brush holder unit having a combined paint containing compartment and a paint brush compartment for respectively receiving paint and a paint brush and being held by the fingers of a user's hand, comprising:

an uprightly disposed body having a top edge extending along a plane and defining an open top and having a bottom extending along a plane parallel to said top edge and with said body extending completely between said top edge and said bottom and having a first lower portion defined by a first endlessly extending wall and being arranged to form an upwardly open paint compartment for containing a supply of paint, said body having a second lower portion defined by a second endlessly extending wall and being arranged to form an upwardly open paint brush compartment for receiving and upwardly supporting the paint brush and for containing paint that flows off the paint brush, said walls which define said compartments respectively extending downwardly and completely to said bottom at an inwardly tapered angulation in an arrangement for nest-stacking said units within each other and there being a space between said walls which define said portions and with the space being arranged for reception of the user's fingers in said space and around said second lower portion for the holding of said unit by the user, and segments of said wall of each of said first and said second lower portions joined together and thereby having a common upper edge disposed intermediate said portions and being disposed to extend across said body and at a location offset from said top edge at an elevation lower than said top edge and thereby present a doctor for the wiping of the brush across said upper edge.

2. The integral paint cup and brush holder as claimed in claim 1, including:

a handle connected to said body and extending therefrom for reception of the hand of the user of said integral paint cup and brush holder, and said handle extending at an angle obtuse to the plane of said top edge in an extending terminal end disposed completely spaced from said body to thereby be arranged to accommodate users' hands of differing sizes when the hand is slid up under the handle and the user's fingers grip the body, and for the nest-stacking of a plurality of said integral paint cup and brush holders.

3. The integral paint cup and brush holder as claimed in claim 1, including:

said body having an upwardly open upper portion disposed between said upper edge and said lower portions and being co-extensive with said upper edge and contiguous with said lower portions for the respective passage of the paint and the paint brush into and out of the respective said lower portions.

4. The integral paint cup and brush holder as claimed in claim 1, wherein:

said top edge is circular and has a central longitudinal axis and said body is conical in shape and circularly extends about said axis.

5. An integral paint cup and brush holder unit having a combined paint containing compartment and a paint brush compartment for respectively containing paint and holding a paint brush and for being held in a user's hand, comprising:

a conically shaped container having an uprightly disposed longitudinal axis and an endless upper rim extending on a plane and circularly around said axis and having two uprightly open and spaced-apart compartments disposed below said upper rim, one of said compartments being arranged for holding the paint and the other of said compartments being arranged to hold the paint brush and with the conical shape being oriented to converge in the direction downward along the axial length of said shape, said compartments being defined in part by respective adjacent and spaced-apart walls disposed at angles relative to each other and to said axis and with the said angles being oriented to have said walls diverge away from each other in an extent away from said upper rim and to have a space between said walls for receiving the fingers on a user's hand for holding the unit, said conical shape and said angles of said walls being disposed for nest-stacking of a plurality of said containers within each other, said container having a bottom on a plane parallel to said upper rim and with both said compartments respectively extending to and along said plane, and said walls being merged into a common edge disposed inside said container at an elevation below said upper rim and presenting a doctor for said brush.

6. The integral paint cup and brush holder as claimed in claim 5, including:

a handle connected to said container and extending therefrom for hand-supporting by a user, and with said handle extending at an angle relative to said axis in an extending end which terminates completely spaced from said container to thereby be arranged for nest-stacking of a plurality of said integral paint cup and brush holders inside each other.

7. The integral paint cup and brush holder as claimed in claim 6, wherein:

said upper rim includes a deviation disposed diametrically opposite from said handle and which is offset from the remainder of said upper rim and thereby presents a pour spout arranged for pouring the paint from said cup.

8. An integral paint cup and brush holder unit for holding a small quantity of paint, such as only a pint of paint, and a paint brush, and for being held by a user's hand when in use, comprising:

a body having a length conically shaped about an upright longitudinal axis for holding paint and having an upper edge and a bottom floor and two portions separated by two spaced-apart walls which extend from said bottom floor uprightly alongside said axis and are disposed within the confines of the conical shape and extend as two chords across the conical shape, said walls being disposed angulated to each other in an arrangement for nest-stacking a plurality of said bodies within each other, said walls having upper ends which are joined together within the confines of said conical shape and which are arranged to present an edge at an elevation below the elevation of said upper edge for wiping the paint brush, and said walls being spaced apart a distance sufficient to accommodate reception of the user's fingers to hold said unit.

9. The integral paint cup and brush holder as claimed in claim 8, including:

a handle connected to said body and having a lower terminal end completely spaced from said body at an angle directed away from said body and being arranged for upwardly receiving a user's hand being slid into the space for lifting said integral paint cup and brush holder and also for rendering said units nest-stackable within each other.

* * * * *